US007547117B1

(12) United States Patent
Russello et al.

(10) Patent No.: US 7,547,117 B1
(45) **Date of Patent: *Jun. 16, 2009**

(54) MULTIPLE POSITION LUMINAIRE AND BRACKET

(75) Inventors: Thomas Russello, Freehold, NJ (US); Dylan Akinrele, Leonia, NJ (US); David S. Monteiro, Belleville, NJ (US); Frank L. Locascio, Howell, NJ (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/835,501

(22) Filed: Aug. 8, 2007

Related U.S. Application Data

(62) Division of application No. 11/683,146, filed on Mar. 7, 2007, and a division of application No. 10/792,477, filed on Mar. 3, 2004, now Pat. No. 7,150,542.

(51) Int. Cl.
*F21V 19/02* (2006.01)

(52) U.S. Cl. ..... 362/285; 362/368; 362/432

(58) Field of Classification Search ..... 362/285, 362/147, 155, 362, 287, 427, 432, 375, 374, 362/366, 368–371, 269
See application file for complete search history.

(56) References Cited

U.S. PATENT DOCUMENTS

| | | | | |
|---|---|---|---|---|
| 1,045,852 | A | | 12/1912 | Jones |
| D51,774 | S | | 2/1918 | Coppinger |
| 1,357,539 | A | | 11/1920 | Bissell |
| 1,633,837 | A | | 6/1927 | Youtz |
| 1,702,746 | A | | 2/1929 | Prichard |
| 2,080,120 | A | | 5/1937 | Everett |
| 2,166,394 | A | | 7/1939 | Crossley |
| 2,758,199 | A | | 8/1956 | Yonkers |
| 2,836,709 | A | | 5/1958 | Van Dusen, Jr. |
| 2,960,361 | A | | 11/1960 | Boutelle |
| 3,040,994 | A | | 6/1962 | Anderson et al. |
| 3,096,029 | A | | 7/1963 | Berge |
| 3,202,070 | A | | 8/1965 | Pratt, Jr. et al. |
| 3,251,987 | A | | 5/1966 | Wince |
| 3,299,265 | A | | 1/1967 | Rackley et al. |
| 3,299,591 | A | | 1/1967 | Woelk |
| 3,340,393 | A | | 9/1967 | Frank et al. |
| 3,347,008 | A | | 10/1967 | Strengholt |
| 3,377,473 | A | * | 4/1968 | Breeding et al. ..... 362/294 |
| 3,388,246 | A | | 6/1968 | Bailey |
| 3,413,462 | A | | 11/1968 | Spero |
| 3,448,260 | A | | 6/1969 | Wince et al. |
| 3,461,283 | A | | 8/1969 | Hahn |
| 3,505,515 | A | | 4/1970 | Adra |
| 3,529,148 | A | | 9/1970 | Stefano et al. |
| 3,543,016 | A | | 11/1970 | Jones |

(Continued)

*Primary Examiner*—Sandra L O'Shea
*Assistant Examiner*—Gunyoung T. Lee
(74) *Attorney, Agent, or Firm*—John F. Salazar; Middleton Reutlinger

(57) ABSTRACT

A multiple position luminaire is described having a hinged lens frame and lens. The lens rotates about a hinge affixed to the luminaire housing, the lens frame being sealed against the luminaire housing with a double gasket seal, a first seal interposed between the lens frame and the housing and the second seal being a plurality of gasket fingers contacting an inner surface of the luminaire side wall.

10 Claims, 15 Drawing Sheets

U.S. PATENT DOCUMENTS 3,604,916 A 9/1971 Adra
3,701,898 A 10/1972 McNamara, Jr.
3,711,702 A 1/1973 Adra
3,940,898 A 3/1976 Kaufman
3,990,201 A 11/1976 Falbel
3,991,905 A 11/1976 Nicpon
4,001,778 A 1/1977 Ross
4,015,394 A 4/1977 Kessler
4,027,151 A 5/1977 Barthel
4,029,630 A 6/1977 Meinhold et al.
4,090,210 A 5/1978 Wehling et al.
4,091,444 A 5/1978 Mori
4,141,061 A 2/1979 Ford et al.
4,143,412 A 3/1979 Sassmannshausen
4,143,413 A 3/1979 Kelly
4,155,111 A 5/1979 Kelly et al.
4,164,784 A 8/1979 Jaksich
4,173,037 A 10/1979 Henderson, Jr. et al.
4,212,050 A 7/1980 Trenkler
4,213,170 A 7/1980 Kimball et al.
4,218,727 A 8/1980 Shemitz et al.
4,229,782 A 10/1980 Ruud et al.
4,240,853 A 12/1980 Pustka
4,242,725 A 12/1980 Douma et al.
4,261,030 A 4/1981 Hernandez
4,293,901 A 10/1981 Hernandez
4,310,876 A 1/1982 Small, Jr. et al.
4,318,237 A 3/1982 Hicks
4,319,313 A 3/1982 Eberhart et al.
4,323,954 A 4/1982 Florence et al.
4,323,956 A 4/1982 Pustka
4,333,131 A 6/1982 Hujimoto et al.
4,364,108 A 12/1982 Rapp
4,395,750 A 7/1983 Scheidemann et al.
4,447,863 A 5/1984 Fenne
4,450,660 A 5/1984 Dean et al.
4,459,789 A 7/1984 Ford
4,462,068 A 7/1984 Shadwick
4,471,411 A 9/1984 Graham et al.
4,473,873 A 9/1984 Quiogue
4,480,809 A 11/1984 Healey
4,527,224 A 7/1985 Sangiamo et al.
4,527,244 A 7/1985 Sangiamo et al.
4,531,180 A 7/1985 Hernandez
4,546,420 A 10/1985 Wheeler et al.
4,587,602 A 5/1986 Dean et al.
4,590,544 A 5/1986 Decandia
4,602,320 A 7/1986 Tomkin et al.
4,623,956 A 11/1986 Conti
4,626,975 A 12/1986 Miletich
4,717,991 A 1/1988 Murphree, Jr.
4,742,436 A * 5/1988 Hoggett ..... 362/549
4,760,511 A 7/1988 Russello et al.
4,766,709 A 8/1988 Galbraith
4,786,344 A 11/1988 Beuther
4,816,969 A 3/1989 Miller
4,893,224 A 1/1990 Tinley
5,016,150 A 5/1991 Gordin et al.
5,062,029 A 10/1991 Engel
5,068,769 A 11/1991 Umeda et al.
5,081,569 A 1/1992 Quiogue et al.
5,099,405 A 3/1992 Gehly et al.
5,111,371 A 5/1992 Nielson
5,140,507 A 8/1992 Harwood
5,183,331 A 2/1993 Edgell et al.
5,278,737 A 1/1994 Luce et al.
5,289,358 A 2/1994 Halemeier
5,309,341 A 5/1994 Russello et al.
D348,745 S 7/1994 Ewing et al.
5,339,234 A 8/1994 Russello et al.
5,377,087 A 12/1994 Yoon
5,386,354 A * 1/1995 Osteen ..... 362/258
5,404,297 A 4/1995 Birk et al.
5,435,087 A 7/1995 Karkar et al.
5,442,132 A * 8/1995 Sandell et al. ..... 174/54
5,446,637 A 8/1995 Cunningham et al.
5,450,303 A 9/1995 Markiewicz et al.
D370,228 S 5/1996 Chapman et al.
5,572,819 A 11/1996 Topinka et al.
5,586,015 A * 12/1996 Baldwin et al. ..... 362/263
5,613,766 A 3/1997 Raouf
5,642,934 A 7/1997 Haddad
5,647,659 A 7/1997 Mori
5,704,710 A 1/1998 Greene et al.
D390,994 S 2/1998 Ewing et al.
D390,995 S 2/1998 Ewing et al.
D391,383 S 2/1998 Ewing et al.
5,722,770 A 3/1998 Douglas
5,743,632 A 4/1998 Carl
5,803,585 A 9/1998 Littman et al.
D400,277 S 10/1998 Ewing et al.
5,826,975 A 10/1998 Hsieh et al.
5,906,431 A 5/1999 Chianale et al.
6,017,131 A 1/2000 Goins
D424,736 S 5/2000 Johnson
6,290,376 B1 9/2001 Gutierrez et al.
6,402,352 B1 6/2002 Summerford et al.
6,450,657 B1 9/2002 Testa et al.
D469,565 S 1/2003 Anderson et al.
6,840,658 B2 1/2005 Anderson et al.
6,905,222 B1 * 6/2005 Russello et al. ..... 362/147
7,059,747 B2 6/2006 Barozzini et al.
7,093,959 B2 * 8/2006 Tsao ..... 362/277
7,121,684 B2 10/2006 Barozzini et al.
7,244,050 B2 7/2007 Summerford et al.
2005/0117333 A1 6/2005 Yoshida et al.

* cited by examiner

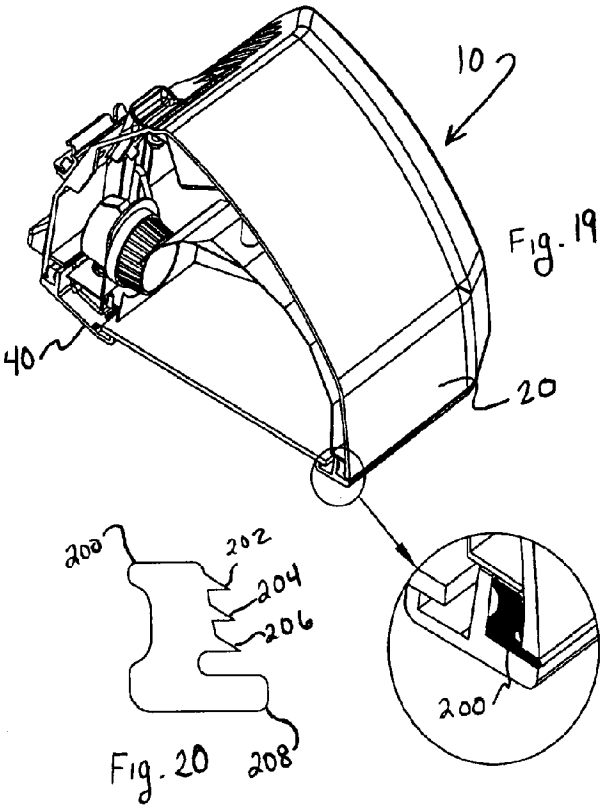
Fig. 19
Fig. 20
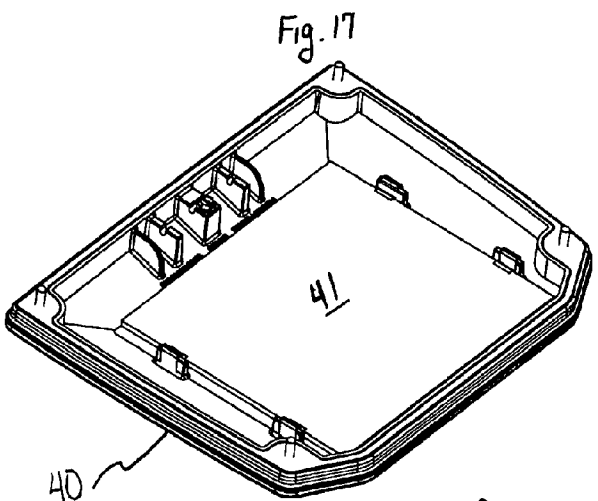
Fig. 17
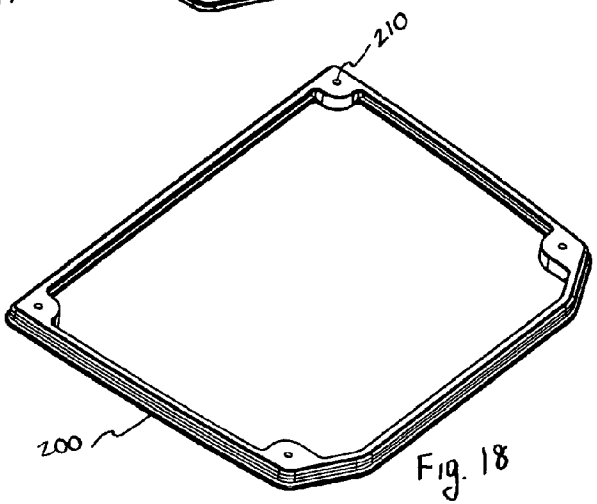
Fig. 18
GASKET / LENSFRAME

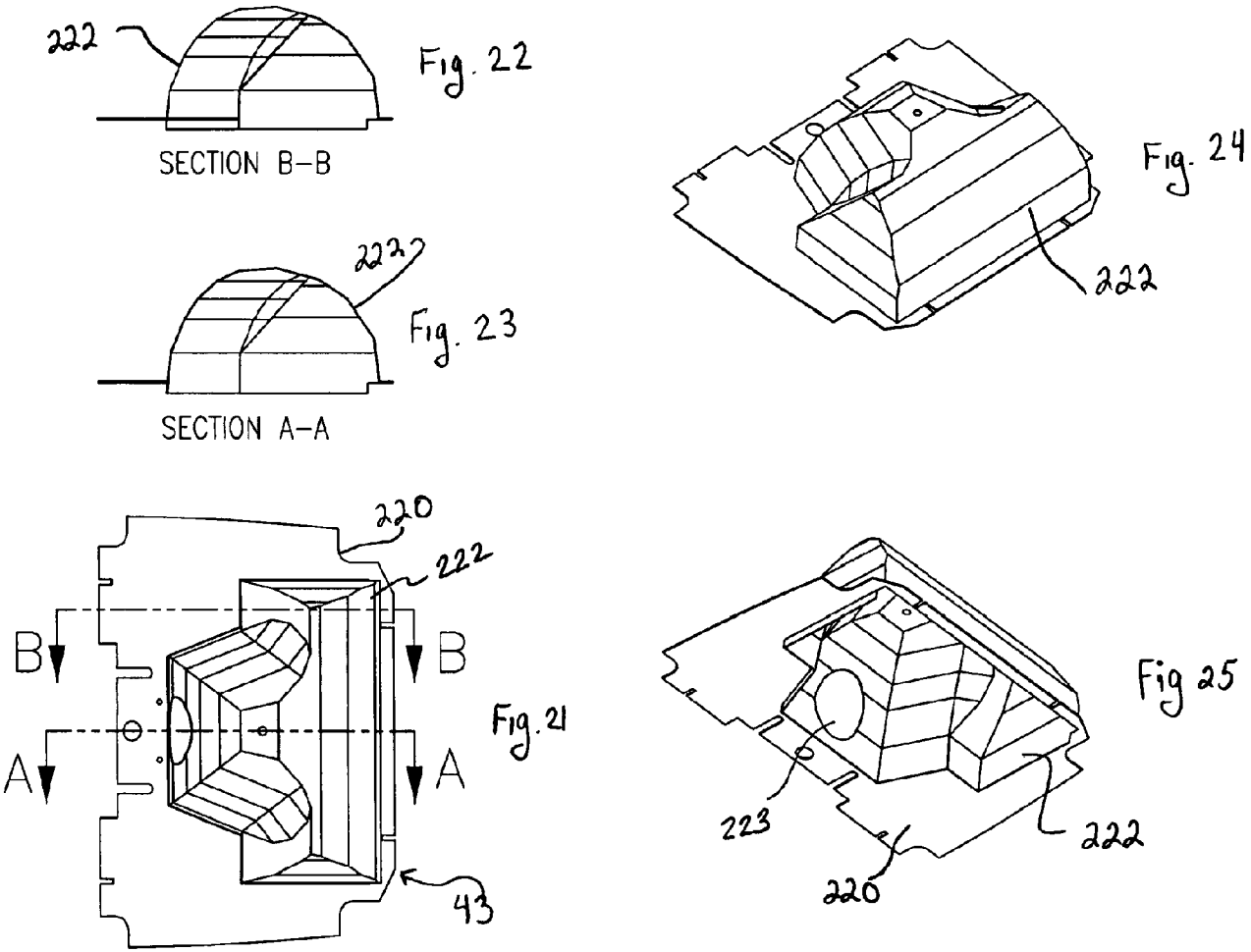
REFLECTOR

MULTIPLE POSITION LUMINAIRE AND BRACKET

CROSS-REFERENCE TO RELATED APPLICATIONS

This divisional application, under 35 USC § 120, claims priority to, and benefit from U.S. application Ser. No. 11/683,146, filed on Mar. 7, 2007, entitled "Gasket for Multiple Position Luminaire," which is currently pending naming the above-named individuals as inventors; which is a divisional of application Ser. No. 10/792,477, filed Mar. 3, 2004, entitled "Multiple Position Luminaire," which is now U.S. Pat. No. 7,150,542, the entire content and disclosure of these applications are hereby incorporated by reference.

FIELD OF THE INVENTION

The present invention is related to a multiple position luminaire and particularly to a luminaire which may be positioned to a plurality of predefined fixed positions against a mounting bracket.

BACKGROUND OF THE INVENTION

Luminaires used for outdoor lighting are typically provided with various bracket mechanisms for mounting purposes. However, it is difficult to provide a luminaire which meets broad cross classification thereby allowing for the luminaire to be placed in many different environments and positions, including floodlight, semi-cutoff as well as indirect lighting. Prior art luminaries for outdoor lighting are typically provided with fixed position mounting capability and lack the ability to be mounted in different environments and across multiple classification.

SUMMARY OF THE INVENTION

In accordance with the present invention, a multiple position luminaire is provided which has a housing surrounding a lamp, the housing having a lens frame hingedly attached to the housing and having a lens affixed thereto. The housing has a plurality of mounting surfaces on a rear portion thereof for mounting against a mounting bracket, the mounting bracket providing mounting or contacting surfaces to engage said mounting surfaces of the housing of the luminaire. The luminaire of the present invention provides multiple functionality across different lighting classifications and provides adequate lighting and meets criteria for floodlights, cutoff and semi-cutoff lighting requirements. The luminaire of the present invention may also be inverted and mounted to the mounting bracket as necessary for indirect lighting. The mounting surfaces of the luminaire housing and the contacting surfaces of the bracket therefore may be designed, as an example, to provide for six fixed positioned mounting angles and positions in order to meet the requisite lighting classification criteria necessary for multiple outdoor lighting applications.

The description set forth in the summary of the invention are exemplary only as the luminaire of the present inventions characteristics may not be fully realized until review of the entire specification and drawings with an addition to the independent claims.

DESCRIPTION OF THE DRAWINGS

All of the objects and benefits of the present invention are set forth here and after with reference to the accompanying drawings and wherein:

FIG. 17 is a top perspective view of the lens frame for the luminaire of the present invention;

FIG. 18 is a top perspective view of the lens frame gasket for the frame of FIG. 17;

FIG. 19 is a sectional view of the assembled luminaire of the present invention;

FIG. 20 is a side sectional view of the lens frame gasket of the present invention;

FIG. 21 is a top view of the reflector for use in the present invention;

FIG. 22 is a side sectional view taken along the lines B-B of FIG. 21;

FIG. 23 is a side sectional view taken along the lines A-A of FIG. 21;

FIG. 24 is a top perspective view of the reflector of FIG. 21;

FIG. 25 is a rear perspective view of the reflector of FIG. 21.

DETAILED DESCRIPTION OF THE INVENTION

Figure 3:
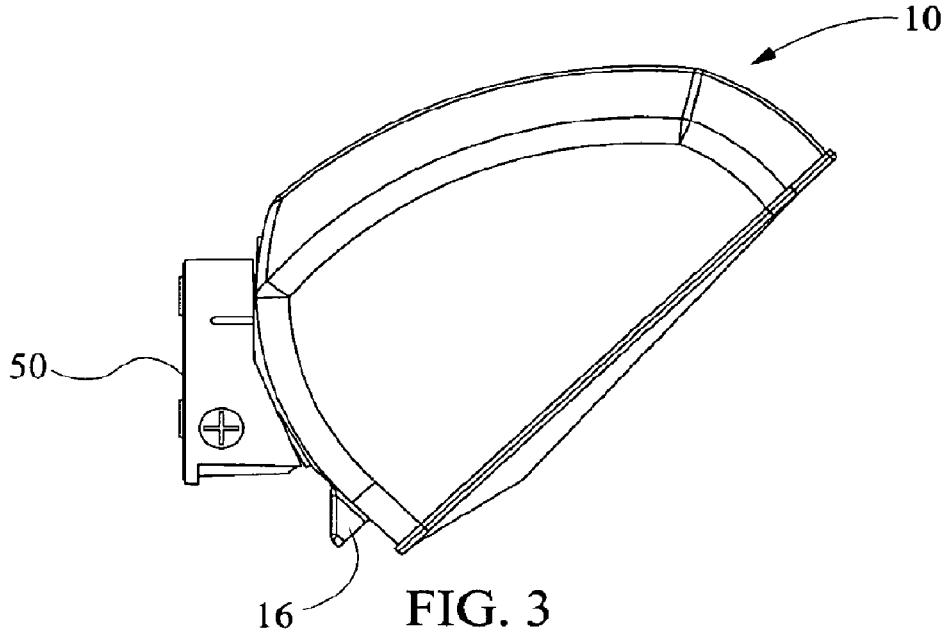
FIG. 3 is a side view of the multi-positioned luminaire of the present invention mounted to the mounting bracket at about 45°.
Figure 4:
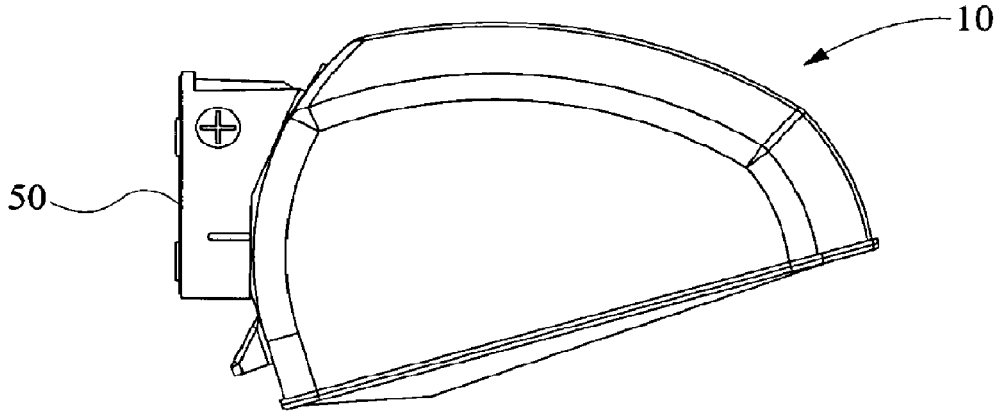
FIG. 4 is a side view of the multi-positioned luminaire of the present invention mounted to the mounting bracket at about 22.5°.
Figure 5:
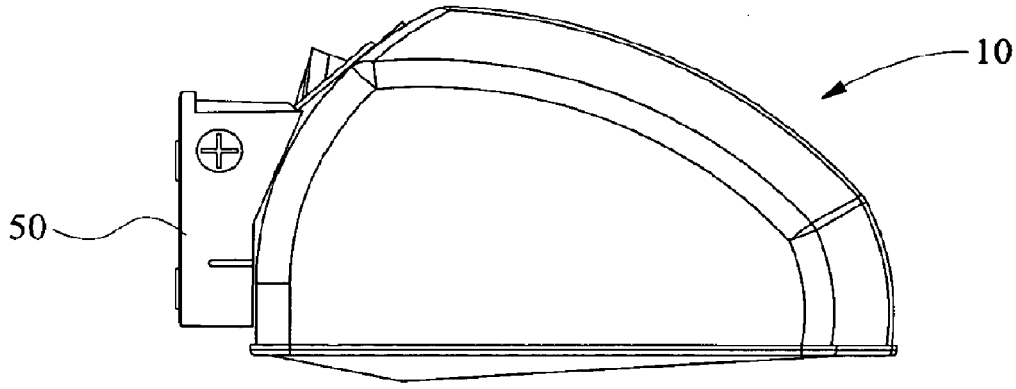
FIG. 5 is a side view of the multi-positioned luminaire of the present invention mounted to the mounting bracket at about 0°.

The assembled and operational multiple positioned luminaire 10 of the present invention is depicted in FIGS. 3, 4 and 5 in the various positions shown. As can be seen from the figures, the luminaire 10 is comprised of the housing 20 which is directly affixed to the mounting bracket 50 and a plurality of positions. The various positions which are depicted may be modified for the appropriate installation requirements needed for the multiple position luminaire 10 of the present invention.

Figure 12A:
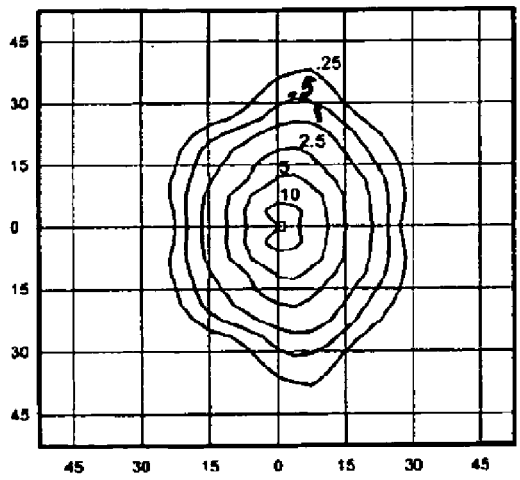
FIGS. 12*a*-12*c* are photometry graphs of the multiple position luminaire of the present invention in the zero degree position.
Figure 12B:
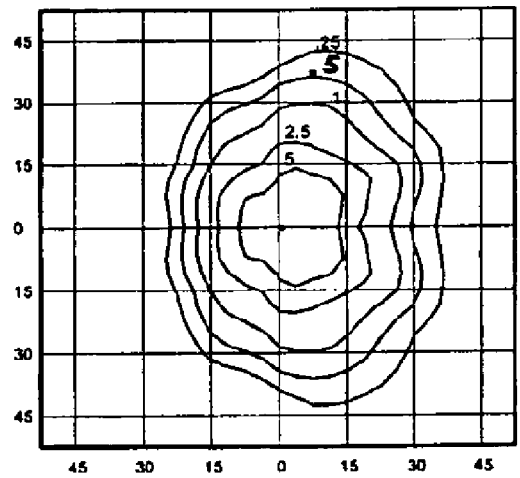
Figure 12C:
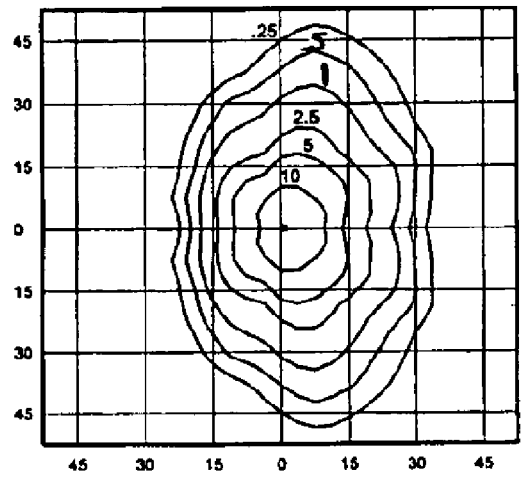
Figure 14A:
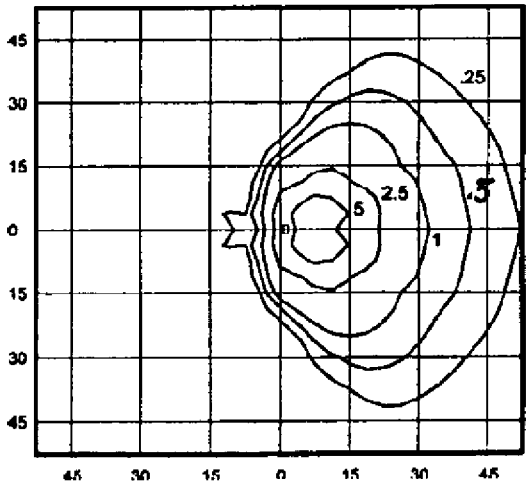
FIGS. 14*a*-14*c* is the photometry distribution of the multiple position luminaire of the present invention at the 45° position.
Figure 14B:
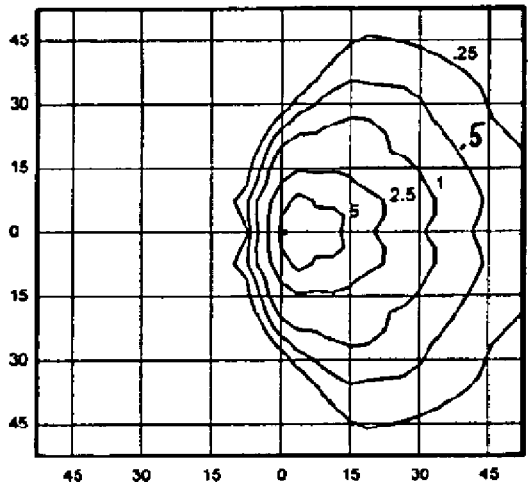
Figure 14C:
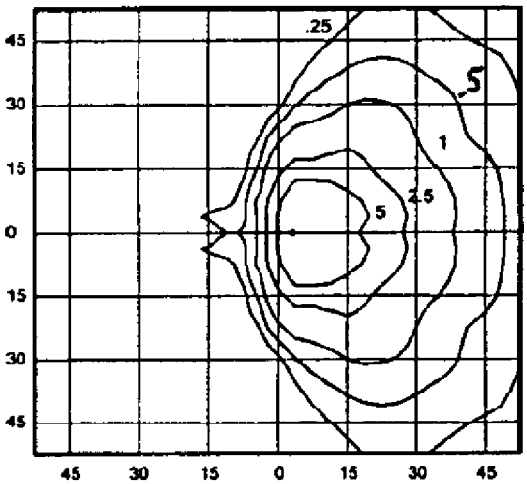

In general, the luminaire 10 of the present invention may qualify for a number of different outdoor lighting classifications such as cutoff, semi-cutoff and floodlighting. As is known, a cutoff is a luminaire light distribution where the candela per 1,000 lamp lumens does not exceed twenty five (2.5%) at or above an angle of 90° above nadir and 100 (10%) at or above a vertical angle 80° above nadir. This further applies to lateral angles around the luminaire. A semi-cutoff luminaire is a luminaire light distribution where the candela per 1,000 lamp lumens does not numerically exceed 50 (5%) at or above an angle of 90° above nadir and 200 (20%) at or above a vertical angle of 80° above nadir. This further applies to all lateral angles around a luminaire. However, both of these descriptions may be modified to the particular requirements needed as well as various other classifications. Further, the multiple position luminaire of the present invention may be mounted as a floodlight for all purpose flood for general lighting. As depicted, when the luminaire is rotated into a position of about 45° off horizontal, the multiple position luminaire 10 of the present invention as depicted in FIG. 3, produces a NEMA 7×6 light distribution pattern for applications requiring a wide beam pattern. Such a lighting distribution is shown in FIGS. 14*a*-14*c* wherein the photometry characteristics in the mounting position of FIG. 3 is shown. When mounted as a cutoff as depicted in FIG. 5 at approximately 0°, the luminaire 10 of the present invention places 80% of the available light down and out where it is needed thereby resulting in fewer fixtures necessary due to the improved spacing ratio. The luminaire 10 of the present invention when mounted in such a position meets the IESNA dark sky requirements due to the ability to direct all the light below 90° thereby reducing glare. The full cutoff photometry when mounted as depicted in FIG. 5 is shown in FIGS. 12*a*-12*c* and provides wide distribution with up to six to one spacing ratio (or spacing to mounting height ratio) for maximum distance between the fixtures. The spacing to mounting height ratio is defined as the spacing between two luminaires such that the illumination on the ground midway between two luminaires is equal to the illumination from one luminaire at nadir. This value is the ratio of the spacing to the mounting height of the luminaires.

Figure 13A:
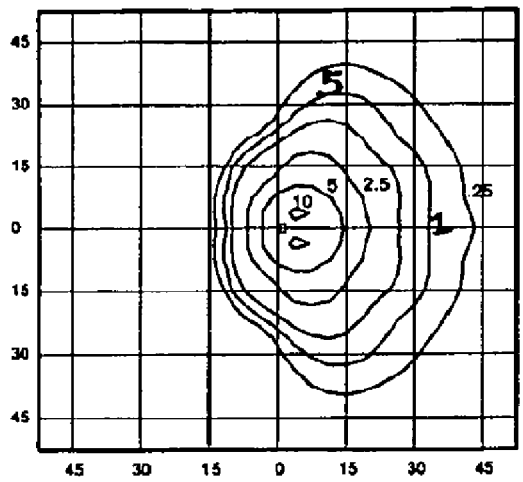
FIGS. 13*a*-13*c* is the photometry graph of the multiple position luminaire of the present invention at the 22.5° orientation.
Figure 13B:
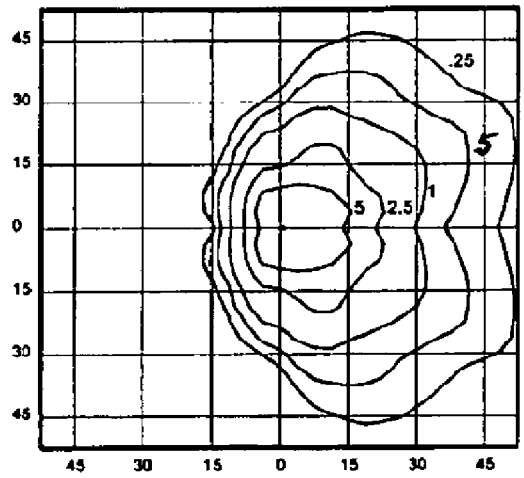
Figure 13C:
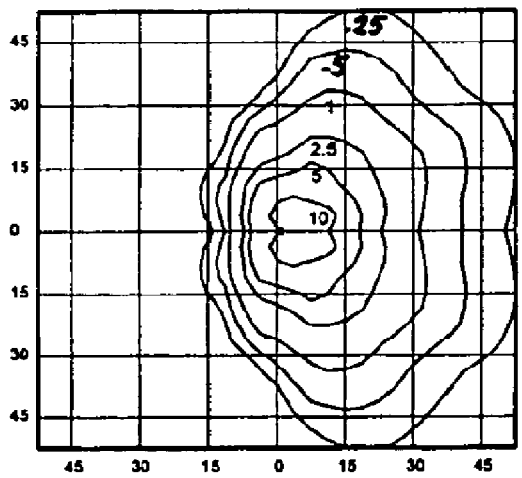

Further, as depicted in FIG. 3, the luminaire 10 of the present invention may be mounted at approximately 25.5° and may convert the luminaire 10 of the present invention to a semi-cutoff optical package luminaire with a forward throw distribution resulting in up to a five to one spacing ratio and photometry shown in FIGS. 13*a*-13*c*.

Each of the photometric distributions depicted in the figures are shown for various lighting capabilities and combinations with lamps which will be herein described.

Figure 1:
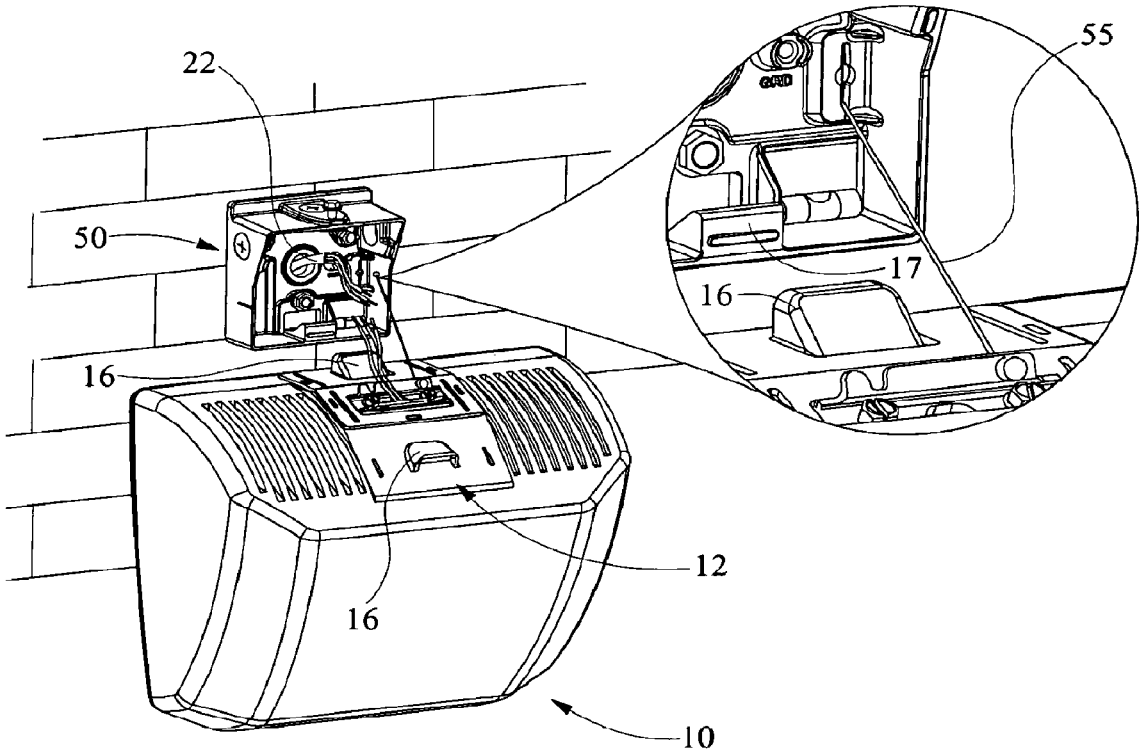
FIG. 1 is a prospective view of the partially disassembled multiple position luminaire of the present invention depicting the luminaire housing and mounting bracket.

The multi-position luminaire 10 of the present invention is adjustable in a number of different mounting positions due to the multi-position mounting surfaces 12, referred to in FIG. 1, which are available. The multi-position mounting surfaces 12 work in conjunction with the mounting bracket 50 thereby allowing the luminaire 10 of the present invention to be mounted in a plurality of positions. As presently depicted, the exemplary positions are shown in FIGS. 3, 4 and 5 wherein the luminaire may be mounted at 45°, 22.5° and 0° to produce a luminaire characteristic of a floodlight, semi-cutoff and cutoff. However, the angular displacement of the multiple mounting surfaces 12 of the present invention in conjunction with the mounting bracket 50 of the present invention shown in the figures may be altered to satisfy a number of different angular and forward throw requirements for positioning at angles other than depicted.

Returning to FIG. 1, the installation of the multi-position luminaire 10 of the present invention is shown wherein the mounting bracket 50 is adhered or affixed to a vertical wall or surface and the electrical connection 22 is fed through the mounting bracket to affix directly to the wiring of the luminaire. As shown, one of the benefits for installation of the present invention is that the luminaire may include a hanging cable 55 which extends outward from the back of the luminaire and may be affixed directly to the mounting bracket after the mounting bracket has been installed against a vertical surface. Thus, the luminaire may be allowed to be directly and temporarily attached to the mounting bracket while the electrical connections 22 are properly affixed together so that the luminaire 10 and electrical components thereof are operably connected to a power source. The hanging cable 55 may be affixed to the mounting bracket so that during installation, the luminaire hangs free allowing hands free operation and for connection of the luminaire to the appropriate wiring. Additionally, optional foothold 16 may be positioned on the rear multiple position mounting surfaces 12 for ease and installation and support of the luminaire 10 of the present invention such that the foothold 16 may mate with appropriate foothold 17 which are found in mounting bracket 50.

Figure 2:
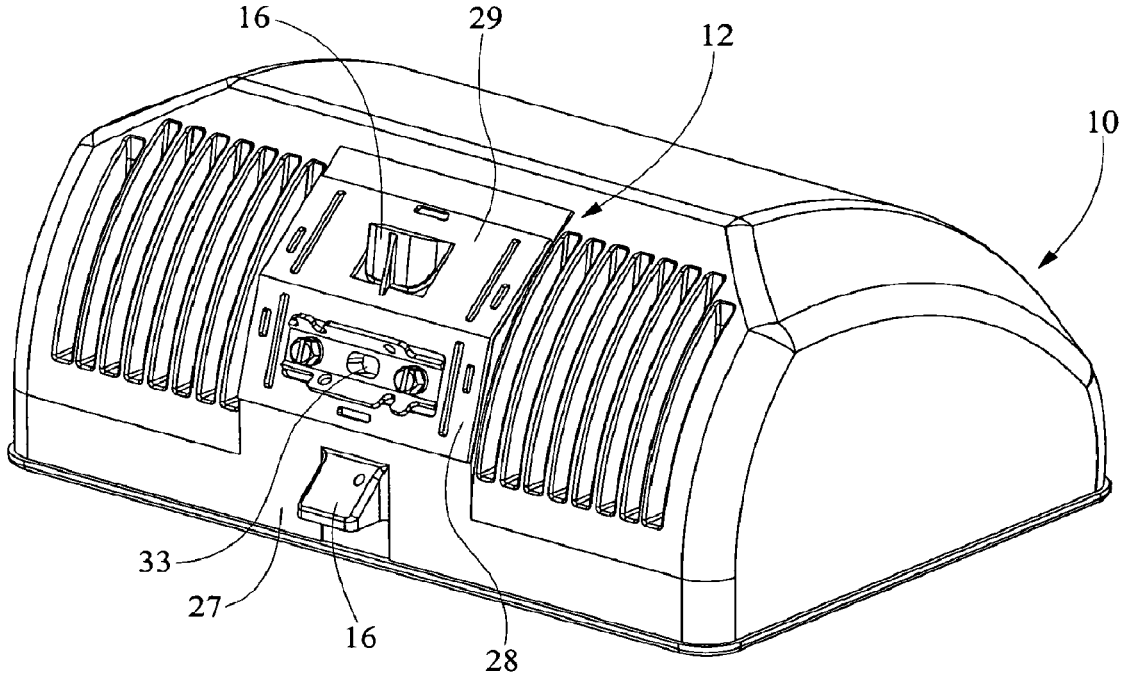
FIG. 2 is a rear prospective view of the multi-position luminaire of the present invention more clearly depicting the multi-position mounting surfaces thereof.

Turning to FIG. 2, a better depiction of the multi-mounting position surfaces 12 of the luminaire 10 of the present invention is shown. The luminaire 10 of the present invention has a housing 20 which may have the multi-position mounting surfaces 12 placed on a rear portion thereof. As depicted in the example of FIG. 2, the multi-position mounting surface 12 of the luminaire 10 of the present invention may include a first mounting surface 29, a second mounting surface 28, and a third mounting surface 27. Each of the mounting surfaces 27, 28 and 29 are designed to provide flat contacting surfaces, as shown in this example, with the mounting bracket 50. However, various surface configurations may be utilized which do not necessarily require the exact construction depicted in the figures and such alternative constructions are considered to fall within the teaching herein.

Returning to FIG. 2, the multi-position mounting surfaces 12 are shown in conjunction with the footholds 16 as well as the electrical connection aperture 33. The mounting surfaces in the present invention as depicted in this example allow the luminaire to be mounted against the mounting bracket 50, as shown in the examples of FIGS. 3-5, to be mounted at angles of 0°, about 22.5° and about 45°. Slight variations may be introduced into the angular displacement or forward throw of the luminaire 10 of the present invention by modifying either the surfaces of the multi-positioned mounting surfaces 12 on the luminaire or the mounting face 59 of the mounting bracket 50, shown in FIGS. 7*a* and 7*b*.

Figures 6A, 6B, 6C, 6D, 6E, 6F:
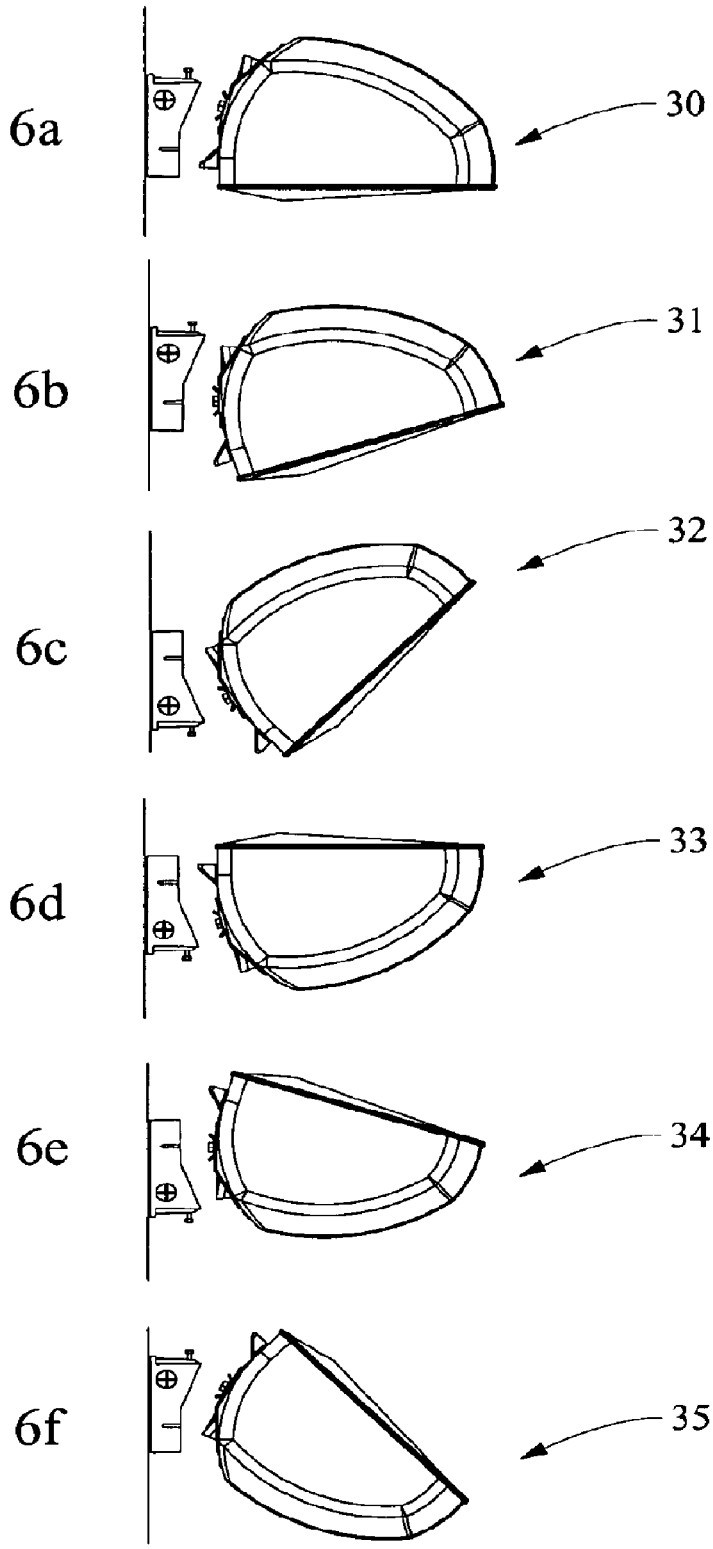
FIGS. 6*a*-6*f* are side view depictions of the multiple position luminaire of the present invention mounted in various orientations.

In the examples for mounting of the multi-position luminaire 10 of the present invention depicted in FIGS. 3, 4 and 5, which correspond to FIGS. 6*a*, 6*b* and 6*c*, the luminaire of the present design allows the mounting surfaces 12 to directly contact or provide adjacent surfaces to the mounting bracket 50. As shown in the examples, two adjacent surfaces of the multi-position mounting surface 12 contact the mounting bracket 50. As shown in FIG. 3, first mounting surface 29 and second mounting surface 28 contact the engagement surfaces 52 and 54 of the mounting bracket 50. Mounting surface 52 may be substantially vertical in this example whereas surface 54 may extend off the vertical axis by about 22 degrees. However such particular embodiments are provided for exemplary purposes only. The example of FIG. 3 allows for the luminaire to be extended upward at a general tilt of approximately 45° based upon the angular displacement of the mounting face 59 of the mounting bracket and each of the contacting surfaces 52, 54 in conjunction with the angular displacement of the first mounting surface 29 and second mounting surface 28.

As shown in FIG. 4, the angular displacement of the luminaire 10 of the present invention may be adjusted to provide approximately 22.5° off of the horizontal by inverting the mounting bracket 50 as shown in FIG. 4 and allowing the mounting face 59 of the bracket to come again in contact with the first mounting surface 29 and second mounting surface 28.

Figure 7A:
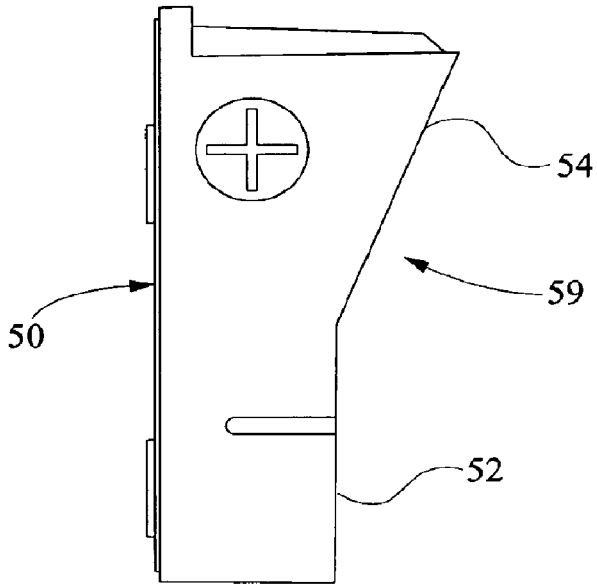
FIGS. 7*a* and 7*b* are side views of the mounting bracket used in the present invention in combination with the multiple position luminaire set forth in FIG. 1.
Figure 7B:
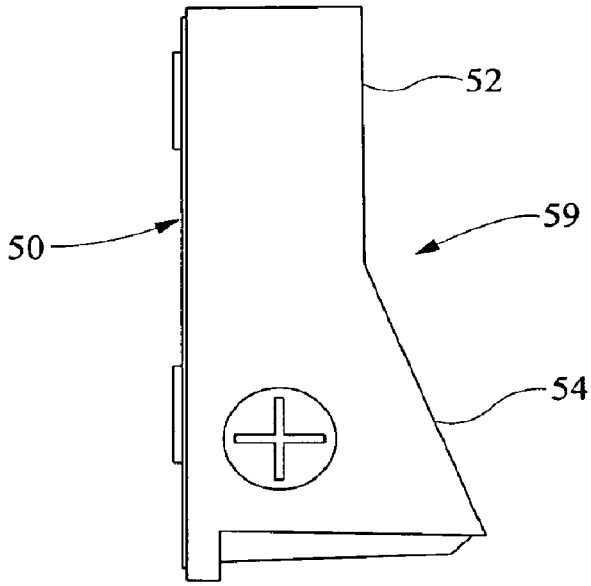

Alternatively, if the mounting bracket is placed in such a position as depicted in FIG. 5 and in FIG. 4, the mounting face 59 of the bracket may be brought into contact with the second mounting surface 28 and third mounting surface 27 of the multi-position mounting surfaces 12 of the luminaire 10 to provide a cutoff luminaire as depicted in FIG. 5 and allowing the luminaire to be placed at approximately 0° from horizontal. As shown in FIGS. 6*a*-6*f*, examples of the potential mounting positions for the luminaire 10 of the present invention are shown. Depicted in FIG. 6*a*, a full cutoff luminaire 30 may be provided when the luminaire is positioned at 0° from horizontal by positioning the mounting bracket 50 as depicted in FIG. 7*a* and allowing the mounting face 59 of the mounting bracket 50 to come into contact with the third and second mounting surfaces 27 and 28 of the luminaire housing 20. As shown, the mounting bracket 50 has a lower mounting face section 52 which is mostly vertical and which contacts a corresponding substantially vertical third mounting surface 27 on the multi-position mounting surfaces 12 of the rear section of the housing 20. The upwardly angled section 54 of the mounting face 59 of the mounting bracket 50 matches the second mounting surface 28 of the housing 20. When mounted at 0°, the cutoff luminaire 30 depicted in FIG. 6*a* offers a wide type 2 distribution with a spacing ratio of up to six to one thereby permitting greater spacing between fixtures when mounted for exterior lighting, particularly as compared to conventional prior art wall pack luminaries. As depicted, the cutoff luminaire 30 produces a photometric distribution as shown in FIG. 12*a*, 12*b* and 12*c* depending on the various embodiments of the housing 20 and lamps used. Further description of housing and lamps will be set forth herein.

Alternatively, a semi-cutoff luminaire 31 is shown in FIG. 6*b* wherein the luminaire is rotated counter-clockwise so that the first and second mounting surfaces 29 and 28 contact the mounting face 59 of the mounting bracket. The semi-cutoff luminaire 31 depicted in the angular offset of approximately 22.5° produces a forward throw distribution resulting in up to a five to one spacing ratio and a photometric distribution depicted in FIGS. 13*a*-13*c*.

Alternatively, if the mounting bracket 50 is inverted to provide an upper mounting surface which is substantially vertical at an angled lower mounting surface 54 on the mounting face 59 of the bracket 50, the luminaire may be rotated to approximately 45° and securely affixed in such position to produce a floodlight luminaire 32 depicted in FIG. 6*c*.

Alternatively, as shown in FIGS. 6*d*, 6*e*, and 6*f*, the brackets 50 and luminaire contacting surfaces may be inverted to provide indirect light functionality as shown in the luminaire embodiments of 33, 34, and 35 shown in FIGS. 6*d*, 6*e* and 6*f*. Such angular displacements may be utilized for a wall washing effects, indirect lighting or accent lighting.

As a result of the combination of the mounting face 59 of the mounting bracket 50 and the plurality of mounting surfaces found on the luminaire 10 of the present invention, the luminaire 10 of the present invention is mountable to a plurality of predefined fixed angular displacements thereby providing multiple contacting surfaces against the mounting bracket 50 to assure the luminaire is securely mounted and affixed to the mounting surface. Further, by use of the combination of the mounting bracket contacting surfaces or mounting faces 59 of the mounting bracket 50 in conjunction with the plurality of multi-position mounting surfaces 12 of the luminaire, the user can be assured of mounting the luminaire at predefined fixed positions by simply installing the mounting bracket as necessary and attaching the mounting bracket directly to the requisite mounting surfaces or surface of the luminaire to produce the offset angle necessary for the application required.

Figure 8:
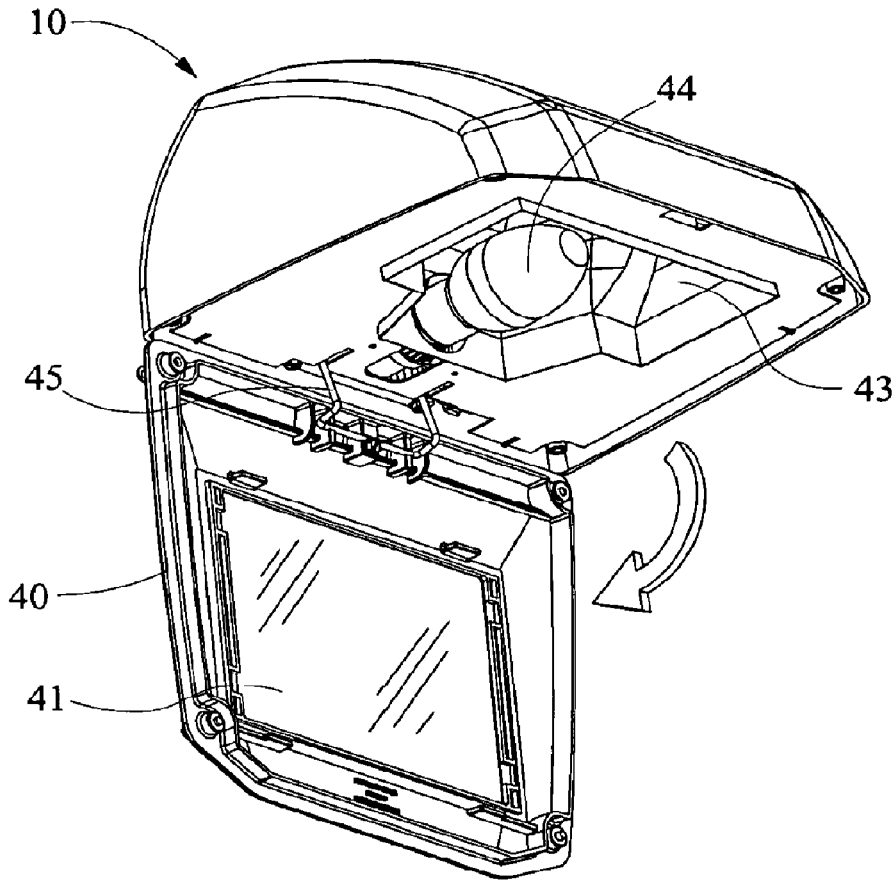
FIG. 8 is a bottom exposed view of the multiple position luminaire of the present invention with the lens frame in the open position.

As shown in FIG. 8, the luminaire 10 of the present invention has a housing 20 which interiorly encloses a lamp 44 which is surrounded by optical reflector 43. The luminaire 10 may also include a lens frame 40 which surrounds a lens 41. The lens frame 40 may be hingedly connected to the luminaire housing 20 by hinge 45. The lens frame 40 may be attached directly to the housing 20 by a number of security screws at each corner as shown. Of note with the design of the present invention is that the lens frame 40 is directly affixed to the housing 20 by the hinge 45. Thus, the lens frame is directly affixed to the housing thereby allowing the housing to be rotated and accessed to be granted to the interior portions of the luminaire 10. Such design allows hands free access to the lamp, ballast or other electronics assembly within the interior of the housing 20. Further, the lens 41 recessed within the lens frame 40 may be offset off of the horizontal by approximately 3° to allow for water and debris runoff from the lens. Such an offset is desirable in that if the luminaire is placed in the 0° inverted position as depicted in FIG. 6*b*, water and other debris will runoff of the lens thereby preventing accumulation thereon. Returning to FIG. 8, the lamp 44 for use within the luminaire 10 of the present invention is depicted. The lamp may be between 150 and 400 watts and may be a high pressure sodium, compact fluorescent, metal halide, pulse start metal halide, or other various light source to provide the necessary lumen output.

Turning to the photometric distributions which are depicted in FIGS. 12*a*-12*c*, FIG. 12*a* depicts the full cutoff 0° offset photometric distribution with a 150 watt high pressure sodium light source. FIG. 12*b* depicts a 175 watt metal halide lamp while FIG. 12*c* depicts a 400 watt metal halide lamp used in a 10"×11½" housing, 12"×13" housing or 15"×18¾" housing respectfully. Similarly, the photometric distribution depicted in FIGS. 13*a*-13*c* shows the result of the luminaire being offset at 22.5° when used in conjunction with a 150 watt high pressure sodium, as depicted in FIG. 13*a*, a 175 watt metal halide as depicted in FIG. 13*b* and a 400 watt metal halide as depicted in FIG. 13*c* lamp source in conjunction with the similar respective housings. Finally, the photometric distribution set forth in FIGS. 14*a*-14*c* are for likewise constructs when the luminaire 10 of the present invention is tilted to a forward throw of approximately 45°. Of course multiple lamp sources and combinations of housings may be utilized as is necessary. As shown however and as is depicted in exemplary fashion, the various luminaire configurations are shown as being 0° down, 22.5° down, 45° down, 0° up, 22.5° up, and 45° up as is depicted in the respective FIG. 6*a*, 6*b*, 6*c*, 6*d*, 6*e* and 6*f*.

Returning to FIG. 8, the hinged lens frame 40 allows for easy access to the interior of the housing 20 for a change out of the lamp or access to the ballast or other electronics.

Figure 9:
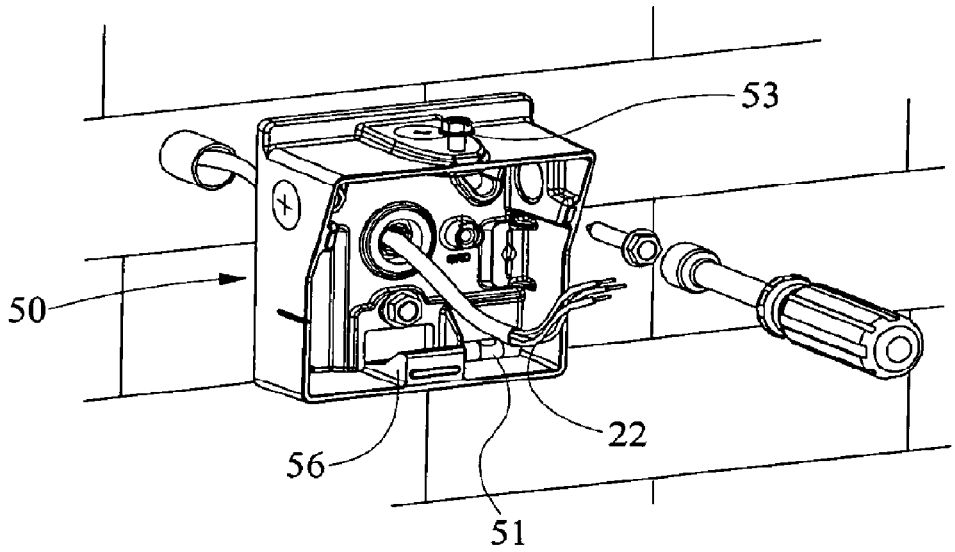
FIG. 9 is a prospective view of the mounting bracket used in conjunction with the multiple position luminaire of the present invention.
Figure 10:
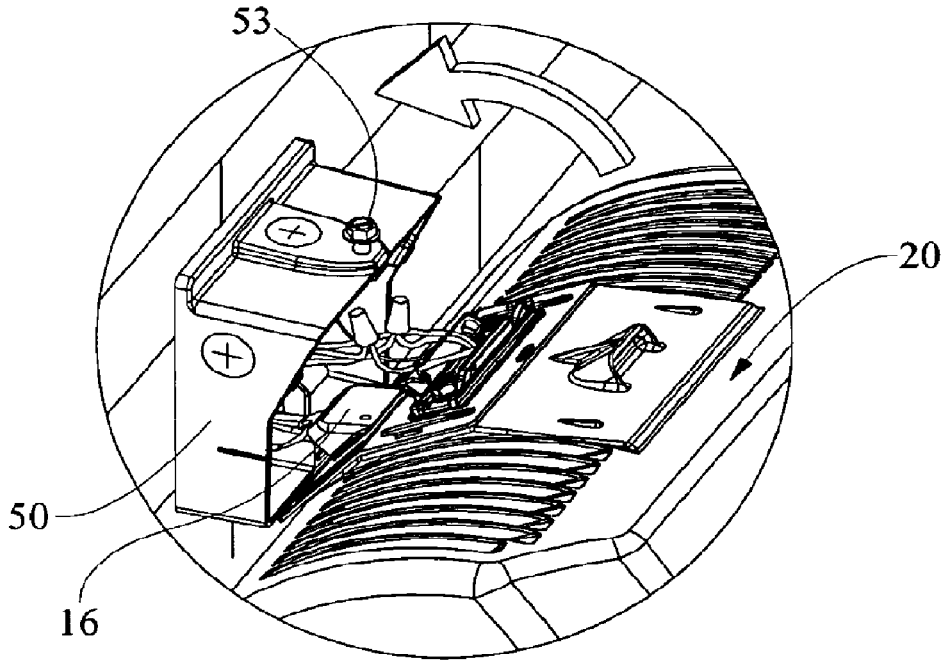
FIG. 10 is a close-up view of the mounting bracket and luminaire used in the present invention.
Figure 11:
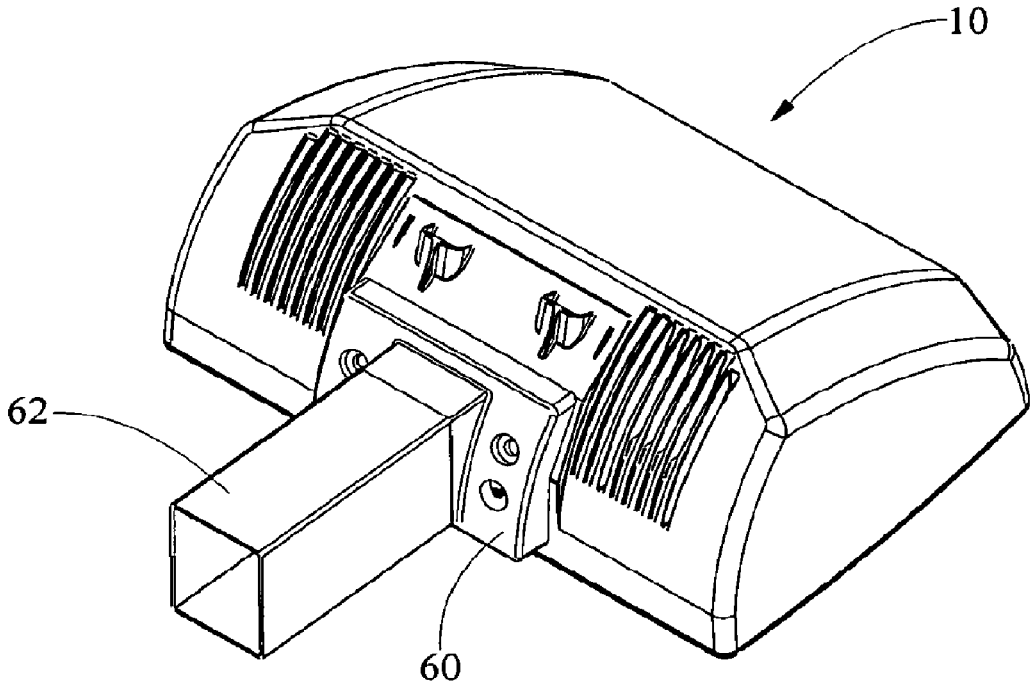
FIG. 11 is an alternative bracketing mechanism for use with the multiple position luminaire of the present invention.

As shown in FIG. 9, the bracket 50 of the present invention allows for easy installation by providing support footing 56 for swiveling of the luminaire housing 20 into the proper positions so that fixation mechanism or load screw 53 may be put into engagement with retaining flange 65, shown in FIG. 2. Further, as shown in FIG. 9, the mounting bracket 50 for use in conjunction with the multi-position luminaire 10 of the present invention may have a rear aperture for threading of the electrical connection wiring 22 there through. Also, to ensure level mounting of the mounting bracket 50 against the vertical surface or wall, the mounting bracket 50 is provided with an interior bubble level 51 to assure that the mounting bracket is placed at the proper orientation for correct installation. The fixation mechanism or tapping screw 53 assures that the luminaire 10 of the present invention is securely affixed directly to the mounting bracket 50 and the contacting of a plurality of surfaces on the backside of the luminaire housing 20 against the contacting surfaces or mounting face 59 of the mounting bracket.

Figure 15A:
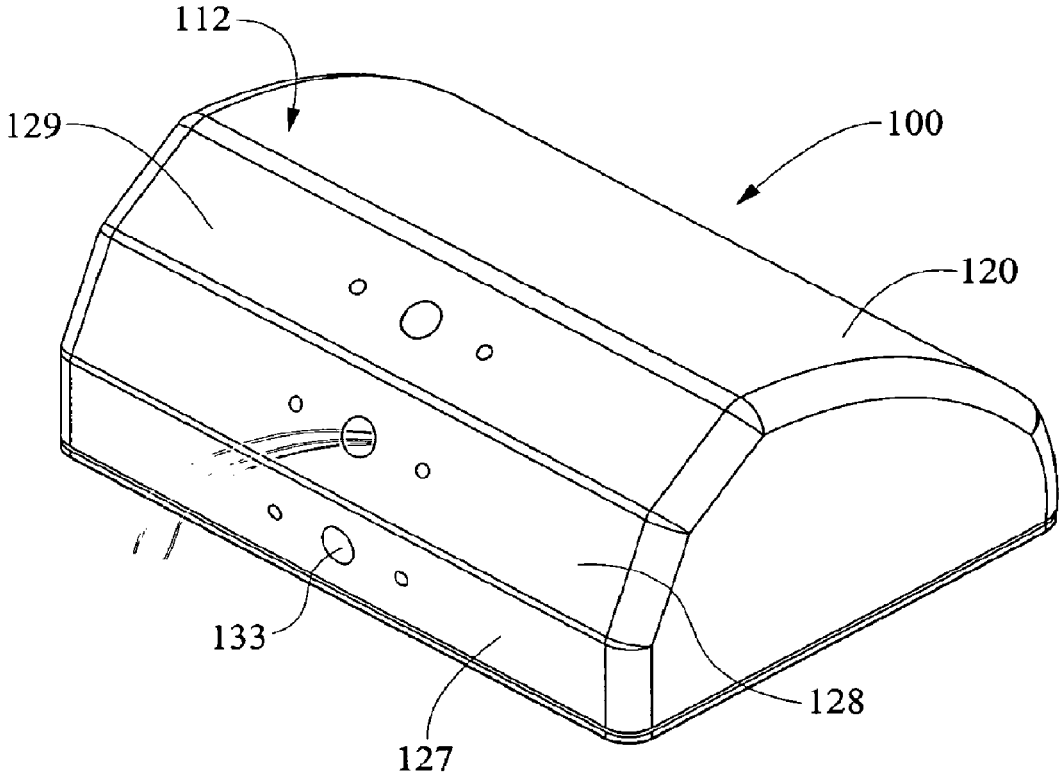
FIG. 15*a* is a rear perspective view of an alternative embodiment for a multiple position luminaire of the present invention.
Figure 15B:
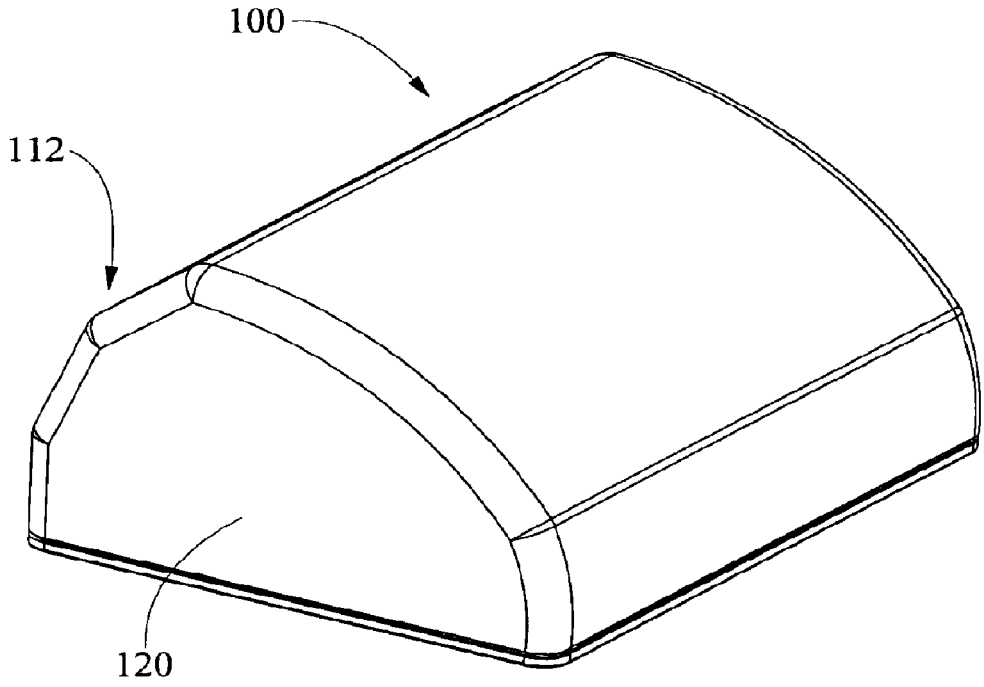
FIG. 15*b* is a front perspective view of the luminaire of FIG. 15*a;*
Figures 15C, 15D, 15E:
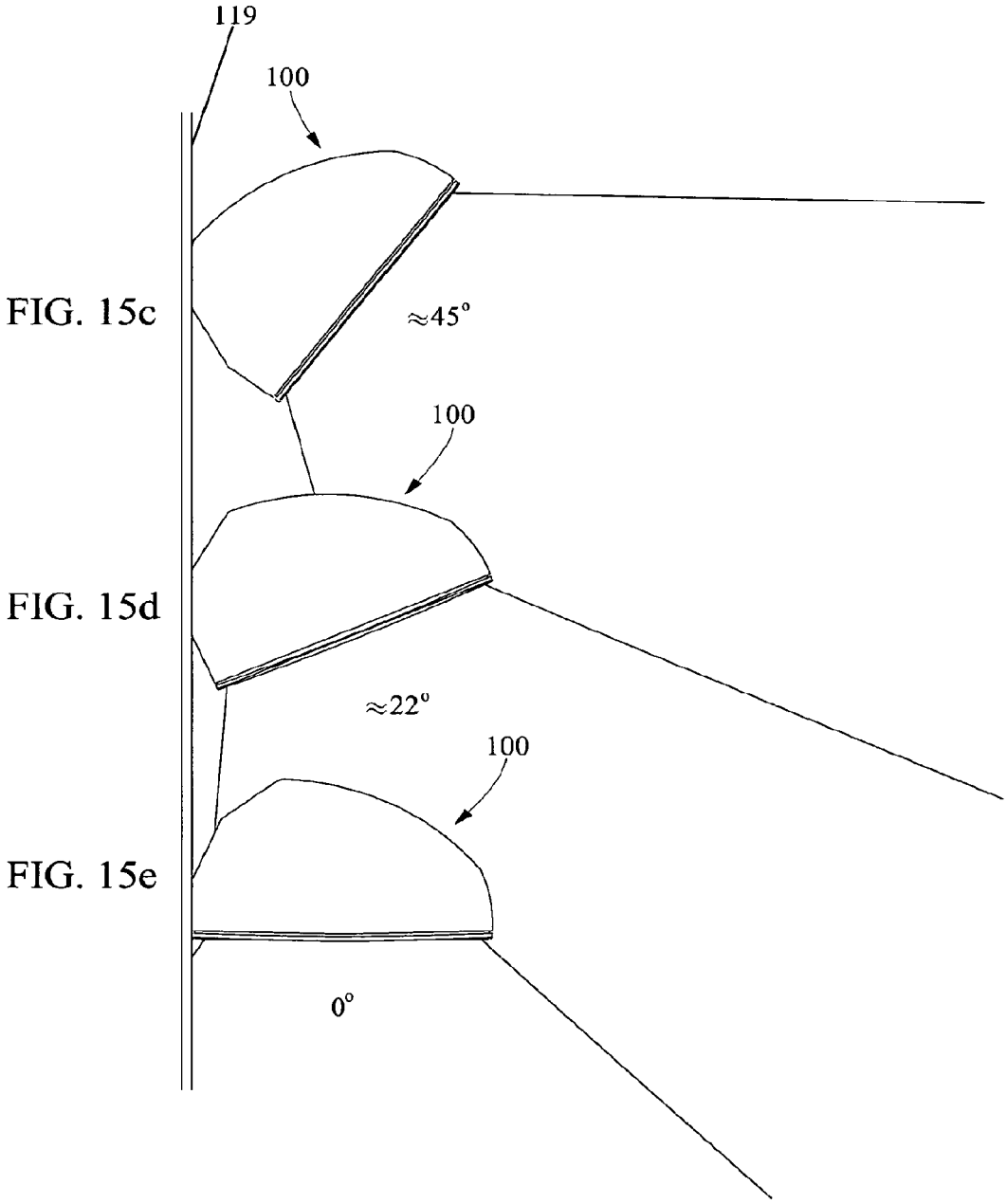
FIGS. 15*c*-15*e* are side mounting views of the luminaire of FIG. 15*a;*

As depicted in FIG. 15*a*, an additional embodiment of the multiple position luminaire of the present invention is shown. The luminaire 100 depicted has a housing 120 with a multi-position mounting surface 112. The multi-position luminaire 100 is positionable along a mounting surface 119, shown in FIGS. 15*c*, 15*d* and 15*e*, along a plurality of mounting surfaces. The mounting surfaces 127, 128 and 129 of the multi-position mounting surface 112 provide the ability for the luminaire 100 to be mounted at a plurality of angles. Each of the mounting surfaces, first mounting surface 127, second mounting surface 128 and third mounting surface 129 provide a pre-defined and fixed mounting angle as is shown in 15*c*-15*e*. FIG. 15*c* depicts mounting along the third mounting surface 129 which produces approximately a 45° angle of inclination with respect to horizontal. Second mounting surface 128 is mounted against the vertical mounting wall 119 and can produce an offset angle of approximately 22½°. Alternatively, first mounting surface 127 produces a 0° offset for full cutoff mount as shown in 15*e*. Of course, in the examples depicted in 15*c*-15*e*, the predefined offsetting mount position can be modified as is necessary for the particular desires and environment of the installation. However, as shown, it is possible with the luminaire 100 of the present invention to produce a luminaire which meets the requisite characteristics for a floodlight, semi-cutoff and cutoff luminaire thereby producing the necessary optics and desirable ISO foot-candle curve for the requisite installations.

The embodiment of the luminaire 100 shown in FIGS. 15*a*-15*e* is only one embodiment for alternative construction of the multiple position luminaire contemplated herein. A significant number of structures are available for use with the luminaire of the present invention such that the luminaire 100 may be connected at a plurality of angles to the vertical or other mounting surface 119 thereby allowing the electrical connection to extend through the connection apertures 133 and positioning the luminaire 100 at a plurality of predefined fixed positions as is shown.

Figure 16:
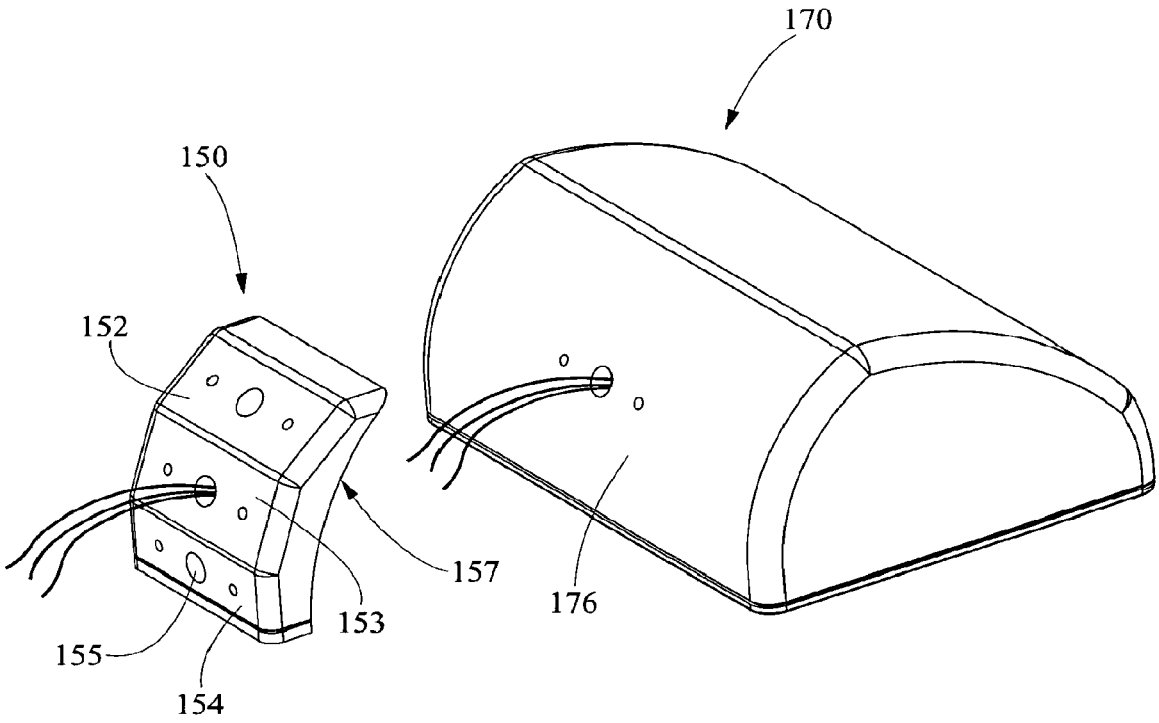
FIG. 16 is a rear perspective view of an additional embodiment for a multiple position luminaire of the present invention.

Alternatively, an additional embodiment of the multi-position luminaire is shown in the luminaire 170 of FIG. 16. As depicted therein, the luminaire 170 has a housing mounting surface 176 which mates with a contacting surface 157 of the multi-position bracket 150. Of course, the housing mounting surface 176 can be of any desirable shape so long as a connection is formed between the luminaire 170 and the multi-positioned bracket 150.

As is shown, the multi-positioned bracket 150 has a plurality of mounting surfaces namely, first mounting surface 154, second mounting surface 153 and third mounting surface 152, each of the mounting surfaces possibly having an aperture 150 through which the electrical connection may extend. The plurality of mounting surfaces allow the combined multi-positioned bracket 150 and luminaire 170 to be mounted against a wall or other mounting connection, such as a pole mount or other desirable position as is available with the other embodiments, such that the luminaire 170 may be positioned in a plurality of pre-defined fixed angular positions with respect to a mounting surface. As is shown in the embodiment of FIG. 16, the luminaire 170 in combination with the multi-position bracket 150 has three pre-defined fixed mounting positions defined by the mounting surfaces on the multi-position bracket 150. As may be necessary and may mimic the examples in FIGS. 15*c*-15*e* as well as FIGS. 3-5 and FIGS. 6*a*-6*f*, the luminaire may be positioned at such pre-defined angular positions such that the luminaire may have optical characteristics necessary for meeting the requirements of a floodlight; semi-cutoff or full cutoff luminaire.

Additionally, the housing mounting surface 176 shown in FIG. 16 may be designed such that the luminaire 170 may be positioned in a downward facing position as is depicted in FIG. 16 or in an upward facing position to present uplight for wallwash indirect light and other necessary indirect lighting requirements.

Turning now to FIG. 17, the lens frame 40 is depicted in an upper perspective. The disassembled lens frame 40 shown in FIG. 17 is hingedly attached to the housing 20 of the luminaire. The lens frame 40 surrounds the lens 41 which, as is previously been described, may be tilted off horizontal by approximately 3° if desired. The 3° tilt of the lens 41 of the luminaire 10 of the present invention allows appropriate water and other debris run off.

Of significant import with regards to the lens frame 40 shown in FIG. 17 is the utilization of an appropriate gasket 200, which is shown in FIG. 18 so that the interior of the luminaire housing 20 is kept dry from the elements. The gasket 200 which is inserted into the periphery of the lens frame 40 contacts an interior edge of the lower section of the housing 20 of the luminaire 10. As shown, the gasket 200 has a plurality of apertures 210 which allow screws or other attachment mechanisms to enter therethrough so that the lens frame 40 may be securely affixed to the housing 20 at various positions.

An additional aspect of the gasket 200 of the present invention for utilization with the luminaire 10 is the fact that the gasket is placed on the exterior edge of the moveable lens frame 40. As a result, the gasket, shown in sectional side view in FIG. 20, is provided with a plurality of fingers 202, 204 and 206, which engage the side of the lower interior surface of the housing 20. As shown in FIG. 19 in a side sectional installed view, the gasket 200 and each of the plurality of fingers 202, 204 and 206 are physically abutting a surface of the lower wall of the luminaire housing 20. Further, an additional sealing or gasket member 208 is provided for interposing between the luminaire lens frame and the housing 20.

In typical luminaire housing construction, utilization of gasket materials are required particularly where there are hingeable or removeable pieces. This is the case since moisture and other foreign elements tend to find their way into the interior of the luminaire housing 20. This can be of particular concern when a high intensity discharge lamp is utilized within the luminaire housing due to the heat that is generated. Because of the high heat levels, increased pressure may be exerted on the luminaire gasketing material such that when a standard single oval or flat gasket is utilized, small imperfections in the gasket may allow water seepage through due to the pressure build up from the heat in the interior of the housing 20. Thus, by providing the plurality of barrier fingers 202, 204 and 206 which face outwardly and rub against the interior side wall of the housing 20, in combination with the gasket member 208, an adequate seal is provided between the lens frame which is hingedly attached to the housing and the housing itself.

An additional benefit of the design of the gasket shown in FIG. 20 is the plurality of fingers 202, 204 and 206. As can be seen from the side sectional view shown therein and in combination with the exploded side section view in FIG. 19, when the lens frame 40 is open and hingedly rotates about the rear edge of the housing 20, the plurality of fingers on the gasket frictionally engage the interior surface of the housing when either opened or closed. This provides a benefit in that any debris or foreign material which is placed or positioned on the interior surface where the gasket abuts the housing 20 is cleaned during either opening or closing of the lens frame 40. Additionally, each of the plurality of fingers 202, 204 and 206 work in conjunction with the lower gasketing member 208 to provide a multiple sealing gasket which not only seals the lens frame with the housing 20 but also provides a gasket sealing function through the lower gasket 208 in combination with the plurality of fingers depicted therein. This further is a benefit in that the plurality of fingers are provided to seal along a different direction or axis than the function of the lower gasket 208. As can be seen, the lower gasket 208 is an inter-position gasket which is interposed between the lens frame and the housing. The plurality of fingers alternatively are outwardly extending and are in outward abutting contact to the interior side wall of the luminaire housing. Thus, a seal is provided along the interior of the side wall and along the bottom edge of the housing.

As shown in FIGS. 21-25, the optics reflector 43 of the present invention is depicted. The optics reflector 43 is comprised of the flat planer section 220 in combination with the actual reflective portion 222 within which the lamp is placed. Thus, the reflector well 222 which is formed in the optics reflector substantially surrounds the lamp 44, shown in FIG. 8, in order to provide the ISO-foot candle curves which are shown in FIGS. 12, 13 and 14. The photometry generated by the optics reflector 43 provides the benefits which have previously been described when in installing the luminaire 10 of the present invention in either the full cutoff, semi-cutoff or floodlight position and generates the photometry depicted in the figures. As is readily ascertainable, the optics reflector 43 is accessible and the interior of the luminaire housing 20 may be reached by opening the lens frame 40 as is shown in FIG. 8. The optics reflector 43 is positioned on the interior of the luminaire housing 20 and a lamp socket is positioned or inserted through the optics reflector aperture 223, such that the lamp 44 is substantially surrounded by the optic well 222 depicted.

From a foregoing description and the various embodiments presented herein, it is understood that the multi-position luminaire of the present invention may be mounted at a plurality of pre-defined fixed positions for selectively choosing the most desirable illumination criteria. Certain modifications and improvements will occur to those skilled in the art upon reading of the foregoing description. It should be understood that any such modifications and improvements are felt to be properly within the scope of the disclosure hereof

We claim:

1. A luminaire and mounting bracket, comprising:

a mounting bracket having a wall mounting surface and an angled mounting face angled relative to said wall mounting surface at between 0° and 90°;

a luminaire having a lens ring surrounding a lens on said luminaire forming a light output plane and at least one angled rear mounting surface and removably affixed to said angled mounting face in a first bracket orientation;

a housing of said luminaire surrounding said lens ring;

wherein said angled rear mounting surface of said luminaire and said angled mounting face of said bracket form complimentary angles relative to said bracket wall mounting surface and a perpendicular plane to said bracket wall mounting surface;

and further wherein said mounting bracket is an invertable bracket removably affixable against said rear mounting surface in a second inverted bracket orientation;

wherein said light output plane of said luminaire is at a predetermined angle of about 0° relative to said perpendicular plane when mounted in said first bracket orientation;

and further wherein light output plane is at greater than a predetermined angle of about 20° relative to said perpendicular plane when mounted in said second bracket orientation.

2. A multiple-position luminaire mountable against an invertible mounting bracket, comprising:

a mounting bracket having a rear mounting face for affixation to a vertical wall and having a luminaire mounting face angled relative to said rear-mounting face, said mounting bracket designed for installation against said vertical wall in a first orientation and a second orientation rotated from said first orientation by about 180°;

a luminaire having a rear mounting surface, a housing surrounding a lens, and a reflector optically adjacent said lens, said luminaire lens forming a light output plane;

an electrical connection extending through said bracket and into said housing when said bracket is installed in both said first orientation and said second orientation;

wherein when said bracket is installed in said first orientation with respect to said luminaire rear mounting surface said angled mounting face mates with said rear mounting surface to place said light output plane at about 0° relative to a plane perpendicular to said rear mounting face and when said bracket is installed at said second orientation with respect to said luminaire rear mounting surface said angled mounting face mates with said rear mounting surface to place said light output plane at a predetermined angle greater than about 22° relative to the plane perpendicular to said rear mounting face.

3. The luminaire of claim 2 wherein said lens is removably affixed to said housing.

4. The luminaire of claim 2 wherein said housing is tethered to said bracket by a hanging cable.

5. The luminaire of claim 2 wherein when said bracket is installed at said first orientation said light output plane is installed at about 0° relative to said perpendicular plane in one of a downward and upward orientation.

6. The luminaire of claim 5 wherein when said bracket is installed at said second orientation said light output plane is installed at least 22° relative to said perpendicular plane in one of a downward and upward orientation.

7. A multiple position luminaire mateable with an invertible mounting bracket, comprising:

a mounting bracket having a rear mounting surface and at least one mounting face engageable with said luminaire;

said luminaire having a housing surrounding a reflector, a lens frame, a lens and a lamp and having at least one mounting surface on a rear portion of said housing, said lens frame forming a light output plane;

wherein said mounting bracket is mounted against a mounting wall in one of a first orientation and a second orientation such that when said mounting bracket is installed in said first orientation said mounting face engages said mounting surface of said housing to place said light output plane of said luminaire at about 0° relative to a plane substantially perpendicular to said rear mounting surface and when said mounting bracket is installed in said second orientation said light output of said luminaire is mounted at a predetermined angle greater than about 22° relative to said plane substantially perpendicular to said rear mounting surface;

wherein said first orientation of said bracket is rotated 180° from said second orientation of said bracket, said mounting surface of said luminaire combines with said mounting face of said bracket to install said luminaire in at least two predetermined fixed positions.

8. The luminaire of claim 7 wherein said luminaire is mounted against said mounting bracket in said first orientation in a second fixed position at about 22° relative to horizontal.

9. A luminaire and installing bracket for mounting the luminaire at multiple fixed angles, comprising:

a bracket having a flat rear face and an angled mounting face angled relative to said rear face;

a luminaire having an angled rear mounting surface and a light output plane defined by a lens frame formed in said luminaire;

said luminaire having a housing surrounding said lens frame;

wherein said angled rear mounting surface mates with said angled mounting face of said bracket to place said light output plane of said luminaire at a predetermined angle of about 90° relative to said flat rear face when said bracket is installed in a first bracket orientation relative to said luminaire angled rear mounting surface and wherein said light output plane of said luminaire is at a predetermined angle of greater than about 90° relative to said flat rear face when said bracket is installed in a second bracket orientation relative to said luminaire angled rear mounting surface;

wherein said first bracket orientation is rotated about 180° relative to said second bracket orientation.

10. A luminaire and mounting bracket combination, comprising:

a bracket having a fiat rear mounting face for mounting against a wall and having a front mounting face, said bracket installed against said wall in one of a first orientation and a second orientation relative to a luminaire;

said luminaire having an angled rear mounting face on a rear portion of a housing, said rear mounting face angled relative to a light output plane defined by a lens ring surrounding a lens of said luminaire;

said housing surrounding said lens ring;

wherein said angled rear mounting face of said luminaire engages said front mounting face of said bracket when said bracket is in said first orientation relative to said luminaire angled rear mounting face and with said wall to position said light output plane at a predetermined position substantially perpendicular to said bracket flat rear mounting face, and further wherein said angled rear mounting face of said luminaire engages said front mounting face of said bracket when said bracket is in said second orientation relative to said luminaire angled rear mounting face and with said wall to position said light output plane at a predetermined position non-perpendicular to said bracket flat rear mounting face;

wherein said first bracket orientation is rotated about 180° relative to said second bracket orientation.

* * * * *